US005891063A

United States Patent [19]

Vigil

[11] Patent Number: 5,891,063

[45] Date of Patent: Apr. 6, 1999

[54] SKIN REJUVINATING SYSTEM

[76] Inventor: Arlene Vigil, P.O. Box 471086, San Francisco, Calif. 94147-1086

[21] Appl. No.: 832,444

[22] Filed: Apr. 3, 1997

[51] Int. Cl.[6] ..... A61H 7/00; A64B 13/02

[52] U.S. Cl. ..... 601/114; 601/109; 601/137; 15/23; 15/28; 15/34; 15/DIG. 5; 15/207.2; D4/102; D4/109; D4/127

[58] Field of Search ..... D4/100, 102, 104, D4/127, 135, 109, 110, 111; D32/35, 40, 52, 14.1, 17; 15/23, 24, 28, 29, 30, 31, 34, 35, 36, 230.16, DIG. 5, 207.2, 176.1–176.6; 601/114, 112, 109, 87, 85, 137, 138

[56] References Cited

U.S. PATENT DOCUMENTS

D. 281,035 10/1985 Herzfeld ..... D4/102

FOREIGN PATENT DOCUMENTS

| | | | |
|---|---|---|---|
| 1021147 | 12/1957 | Germany | 15/29 |
| 1178180 | 9/1964 | Germany | 15/28 |
| 2400787 | 7/1975 | Germany | 15/28 |
| 4308444 | 9/1994 | Germany | 15/28 |
| 2092003 | 8/1982 | United Kingdom | 15/28 |

*Primary Examiner*—Danton D. DeMille

[57] ABSTRACT

A new Skin Rejuvinating System for exfoliating the user's skin thereby facilitating blood movement and reducing cellulite by utilizing a brushing means controlled at various rotational speeds depending on the sensitivity of the user's skin. The inventive device includes a motor encasement, a motor means secured within the motor encasement, a controller means electronically connected to the motor means, a power source electronically connected to the controller means, and a brushing means rotatably secured to the motor means.

3 Claims, 3 Drawing Sheets

SKIN REJUVINATING SYSTEM

BACKGROUND OF THE INVENTION

1. Field of the Invention

The present invention relates to Massaging Devices and more particularly pertains to a new Skin Rejuvinating System for exfoliating the user's skin thereby facilitating blood movement and reducing cellulite by utilizing a brushing means controlled at various rotational speeds depending on the sensitivity of the user's skin.

2. Description of the Prior Art

The use of Massaging Devices is known in the prior art. More specifically, Massaging Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Massaging Devices include U.S. Pat. No. 3,968,789; U.S. Pat. No. 5,423,102; U.S. Design Pat. No. 245,883; U.S. Design Pat. No. 274,957; U.S. Design Pat. No. 250,228 and U.S. Design Pat. No. 262,672.

While these devices fulfill their respective, particular objectives and requirements, the aforementioned patents do not disclose a new Skin Rejuvinating System. The inventive device includes a motor encasement, a motor means secured within the motor encasement, a controller means electronically connected to the motor means, a power source electronically connected to the controller means, and a brushing means rotatably secured to the motor means.

In these respects, the Skin Rejuvinating System according to the present invention substantially departs from the conventional concepts and designs of the prior art, and in so doing provides an apparatus primarily developed for the purpose of exfoliating the user's skin thereby facilitating blood movement and reducing cellulite by utilizing a brushing means controlled at various rotational speeds depending on the sensitivity of the user's skin.

SUMMARY OF THE INVENTION

In view of the foregoing disadvantages inherent in the known types of Massaging Devices now present in the prior art, the present invention provides a new Skin Rejuvinating System construction wherein the same can be utilized for exfoliating the user's skin thereby facilitating blood movement and reducing cellulite by utilizing a brushing means controlled at various rotational speeds depending on the sensitivity of the user's skin. The general purpose of the present invention, which will be described subsequently in greater detail, is to provide a new Skin Rejuvinating System apparatus and method which has many of the advantages of the Massaging Devices mentioned heretofore and many novel features that result in a new Skin Rejuvinating System which is not anticipated, rendered obvious, suggested, or even implied by any of the prior art Massaging Devices, either alone or in any combination thereof.

To attain this, the present invention generally comprises a motor encasement, a motor means secured within the motor encasement, a controller means electronically connected to the motor means, a power source electronically connected to the controller means, and a brushing means rotatably secured to the motor means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Skin Rejuvinating System apparatus and method which has many of the advantages of the Massaging Devices mentioned heretofore and many novel features that result in a new Skin Rejuvinating System which is not anticipated, rendered obvious, suggested, or even implied by any of the prior art Massaging Devices, either alone or in any combination thereof.

It is another object of the present invention to provide a new Skin Rejuvinating System which may be easily and efficiently manufactured and marketed.

It is a further object of the present invention to provide a new Skin Rejuvinating System which is of a durable and reliable construction.

An even further object of the present invention is to provide a new Skin Rejuvinating System which is susceptible of a low cost of manufacture with regard to both materials and labor, and which accordingly is then susceptible of low prices of sale to the consuming public, thereby making such Skin Rejuvinating System economically available to the buying public.

Still yet another object of the present invention is to provide a new Skin Rejuvinating System which provides in the apparatuses and methods of the prior art some of the advantages thereof, while simultaneously overcoming some of the disadvantages normally associated therewith.

Still another object of the present invention is to provide a new Skin Rejuvinating System for exfoliating the user's skin thereby facilitating blood movement and reducing cellulite by utilizing a brushing means controlled at various rotational speeds depending on the sensitivity of the user's skin.

Yet another object of the present invention is to provide a new Skin Rejuvinating System which includes a motor encasement, a motor means secured within the motor encasement, a controller means electronically connected to the motor means, a power source electronically connected to the controller means, and a brushing means rotatably secured to the motor means.

Even still another object of the present invention is to provide a new Skin Rejuvinating System wherein the user is able to rejuvenate their skin by removing dead skin.

Still another object of the present invention is to provide a new Skin Rejuvenating System that facilitates the removal of cellulite from the user's body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
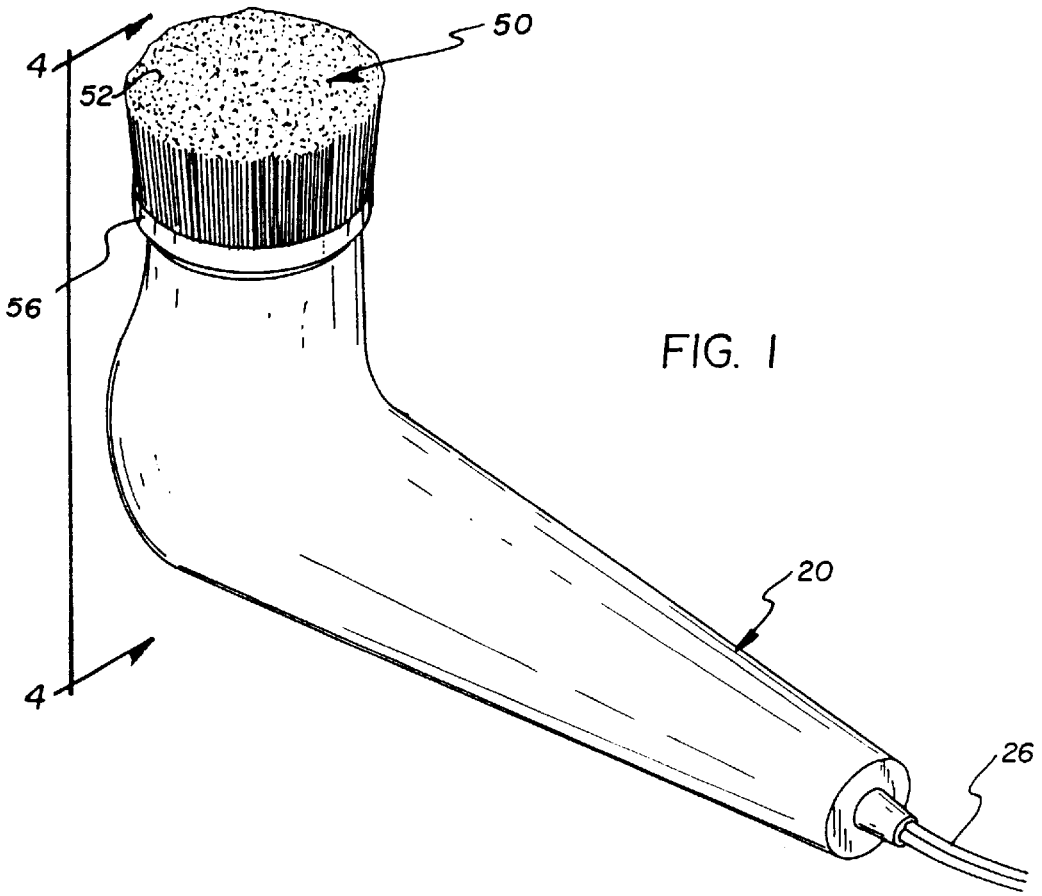
FIG. 1 is a side perspective view of a new Skin Rejuvinating System according to the present invention.
Figure 2:
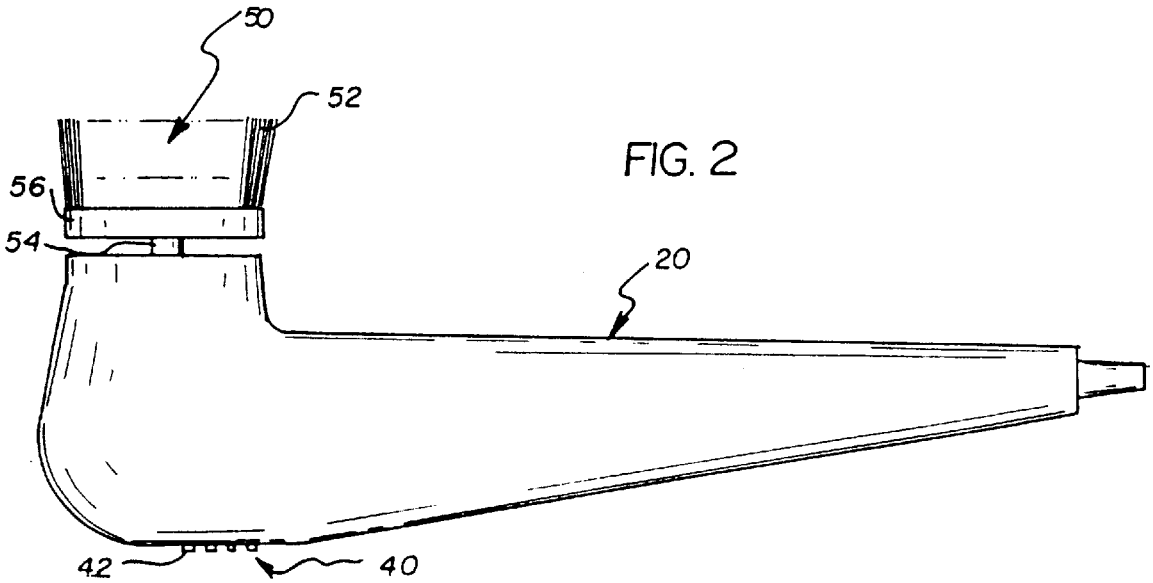
FIG. 2 is a side view thereof.
Figure 3:
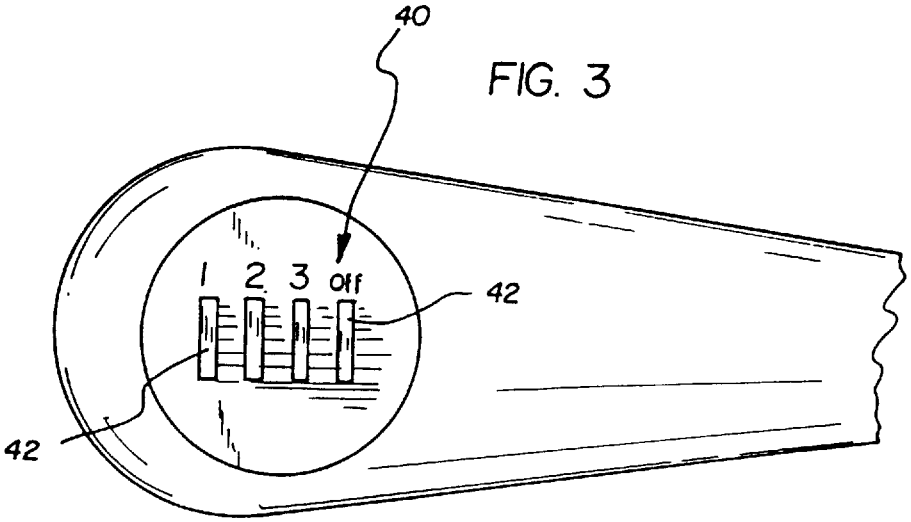
FIG. 3 is a top view of the controller means of the present invention.
Figure 4:
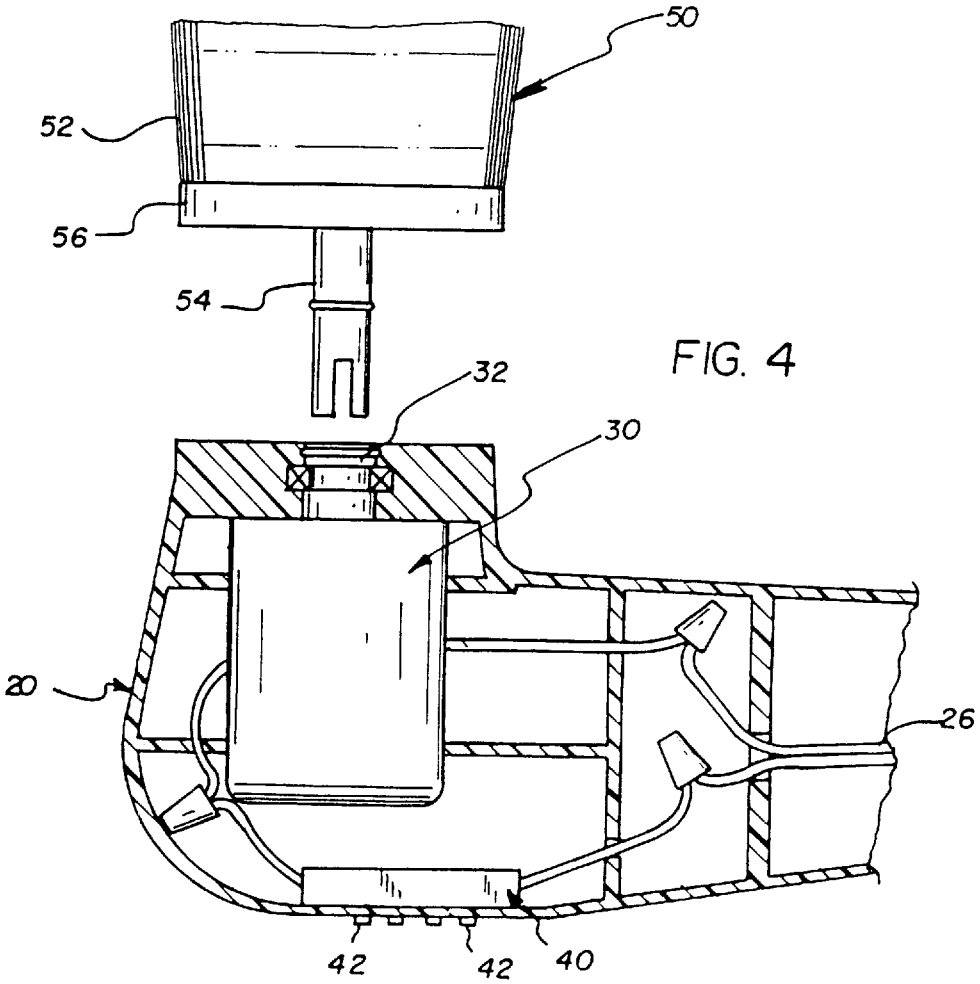
FIG. 4 is a cross sectional view taken along line 4—4 of FIG. 1.

With reference now to the drawings, and in particular to FIGS. 1 through 6 thereof, a new Skin Rejuvinating System embodying the principles and concepts of the present invention and generally designated by the reference numeral 10 will be described.

More specifically, it will be noted that the Skin Rejuvinating System 10 comprises a motor encasement 20, a motor means 30 secured within the motor encasement 20, a controller means 40 electronically connected to the motor means 30, a power source 26 electronically connected to the controller means 40 and a brushing means 50 rotatably secured to a motor drive shaft 32 of the motor means 30.

As best illustrated in FIGS. 1 through 4, it can be shown that the controller means 40 includes at least one controller button member 42 which allows the user to vary the speed of the motor means 30 depending on the user's type of skin. The brushing means 50 includes a plurality of bristle members 52 secured to a bristle support member 56 whereby the plurality of bristle members 52 project perpendicular from the bristle support member 56 forming a flat surface opposite of the bristle support member 56 that the user can rotate against his skin as best shown in FIG. 1 of the drawings. A coupling shaft 54 is secured to the center of the bristle support member 56 opposite of the plurality of bristle members 52 where the coupling shaft 54 couples to the motor drive shaft allowing rotation of the brushing means 50 by the motor means 30 when the controller means 40 is manipulated by the user.

Figure 5:
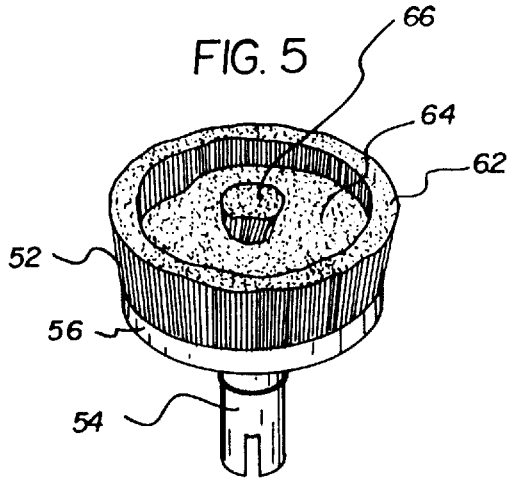
FIG. 5 is a perspective view of an alternative brushing means.

As shown in FIG. 5, an alternative brushing means 50 includes an elevated outer bristle ring 62 secured to the bristle support member 56 formed by a plurality of bristle members 52. A lower inner bristle ring 64 is secured to the bristle support member 56 inside of the elevated outer bristle ring 62 where the lower inner bristle ring 64 is lower in height than the elevated outer bristle ring 62. An elevated center bristle cylinder 66 is secured to the bristle support member 56 inside of the lower inner bristle ring 64 where the elevated center bristle cylinder 66 is approximately the same height as the elevated outer bristle ring 62. A coupling shaft 54 is secured to the center of the bristle support member 56 opposite of the plurality of bristle members 52. The end opposite of the bristle support member 56 of the coupling shaft 54 couples to the motor drive shaft 32 allowing the motor means 30 to rotate the brushing means 50 in a circular motion exfoliating the skin.

Figure 6:
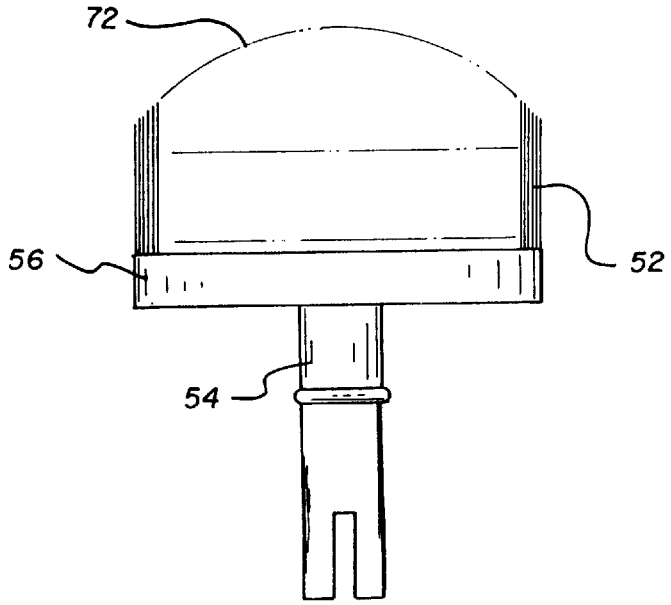
FIG. 6 is a side view of still another brushing means.

As shown in FIG. 6, another alternative brushing means 50 includes an arcuate bristle member 72 that has a plurality of bristle members 52 secured to the bristle support member 56. A coupling shaft 54 is secured to the center of the bristle support member 56 opposite of the plurality of bristle members 52. The end of the coupling shaft 54 opposite of the bristle support member 56 couples to the motor drive shaft 32 that rotates the brushing means 50 in a circular motion.

In use, the user engages a controller button member 42 which facilitates the motion of the motor means 30 which rotates the motor drive shaft 32 coupled to the coupling shaft 54 of the brushing means 50 thereby rotating the brushing means 50. While the brushing means 50 is rotating, the user presses the brushing means 50 against the user's skin which exfoliates the skin and removes cellulite. The user is able to adjust the speed of the rotation of the brushing means 50 by simply depressing another controller button member 42 of the desired speed. When the user is finished, he may detach the brushing means 50 thereby allowing him to clean the plurality of bristle members 52 with any cleaning solution. The plurality of bristle members 52 preferably are constructed from a resilient material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A skin rejuvinating system comprising:

a motor encasement;

a motor means secured within the motor encasement;

a controller means electronically connected to the motor means;

a power source electronically connected to the controller means;

a brushing means rotatably secured to a motor drive shaft of the motor means;

wherein the controller means includes at least one controller button member which varies the speed of the motor means; and wherein the brushing means includes a bristle support member; an elevated outer bristle ring formed by a plurality of bristle members secured to the bristle support member; a lower inner bristle ring secured to the bristle support member inside of the elevated outer bristle ring and lower in height than the elevated outer bristle ring; an elevated center bristle cylinder secured to the bristle support member inside of the lower inner bristle ring and approximately the same height as the elevated outer bristle ring; and a coupling shaft secured to the center of the bristle support member opposite of the plurality of bristle members where the coupling shaft end opposite of the bristle support member couples to the motor drive shaft.

2. A skin rejuvenating system comprising:

a motor encasement, said encasement having a head end tapering towards a tail end;

a motor secured within the motor encasement;

a controller means for controlling said motor, said controller means being electronically connected to the motor;

a power source electronically connected to the controller means; and a brushing means for brushing, said brushing means being positioned proximate said head end, said brushing means being connected to said motor such that said brushing means is rotated by said motor;

wherein the brushing means includes a bristle support member; an elevated outer bristle ring formed by a plurality of bristle members secured to the bristle support member; a lower inner bristle ring secured to the bristle support member inside of the elevated outer bristle ring and lower in height than the elevated outer bristle ring; an elevated center bristle cylinder secured to the bristle support member inside of the lower inner bristle ring and approximately the same height as the elevated outer bristle ring; and a coupling shaft secured to the center of the bristle support member opposite of the plurality of bristle members where the coupling shaft end opposite of the bristle support member couples to the motor drive shaft.

3. A skin rejuvenating system comprising:

a motor encasement, said encasement having a head end tapering towards a tail end;

a motor secured within the motor encasement;

a controller means for controlling said motor, said controller means being electronically connected to the motor;

a power source electronically connected to the controller means; and a brushing means for brushing, said brushing means being positioned proximate said head end, said brushing means being connected to said motor such that said brushing means is rotated by said motor;

wherein the controller means includes at least one controller button member which varies the speed of the motor means;

wherein the brushing means includes a bristle support member; an elevated outer bristle ring formed by a plurality of bristle members secured to the bristle support member; a lower inner bristle ring secured to the bristle support member inside of the elevated outer bristle ring and lower in height than the elevated outer bristle ring; an elevated center bristle cylinder secured to the bristle support member inside of the lower inner bristle ring and approximately the same height as the elevated outer bristle ring; and a coupling shaft secured to the center of the bristle support member opposite of the plurality of bristle members where the coupling shaft end opposite of the bristle support member couples to the motor drive shaft.

* * * * *